US007903986B2

(12) United States Patent
Tanaka et al.

(10) Patent No.: US 7,903,986 B2
(45) Date of Patent: Mar. 8, 2011

(54) REUSE METHOD AND A REUSABLE DEVICE FOR AN IMAGE FORMING APPARATUS HAVING A FIRST PROCESS LINEAR VELOCITY AND A SECOND IMAGE PROCESSING APPARATUS HAVING A SECOND PROCESS LINEAR VELOCITY

(75) Inventors: Kayoko Tanaka, Machida (JP); Shin Hasegawa, Zama (JP); Hitoshi Ishibashi, Kamakura (JP); Shuji Hirai, Tokyo (JP); Kohta Fujimori, Yokohama (JP); Nobutaka Takeuchi, Yokohama (JP); Yushi Hirayama, Sagamihara (JP); Akira Yoshida, Kawasaki (JP)

(73) Assignee: Ricoh Company Limited, Tokyo (JP)

( * ) Notice: Subject to any disclaimer, the term of this patent is extended or adjusted under 35 U.S.C. 154(b) by 58 days.

(21) Appl. No.: 12/431,243

(22) Filed: Apr. 28, 2009

(65) Prior Publication Data

US 2009/0279907 A1 Nov. 12, 2009

(30) Foreign Application Priority Data

May 8, 2008 (JP) ..... 2008-122295

(51) Int. Cl.
*G03G 15/08* (2006.01)

(52) U.S. Cl. ..... 399/27; 399/30

(58) Field of Classification Search ..... 399/27, 399/30, 62, 63, 109, 119
See application file for complete search history.

(56) References Cited

U.S. PATENT DOCUMENTS

| | | | |
|---|---|---|---|
| 5,182,600 | A | 1/1993 | Hasegawa et al. |
| 5,198,861 | A | 3/1993 | Hasegawa et al. |
| 5,327,196 | A | 7/1994 | Kato et al. |
| 5,387,965 | A | 2/1995 | Hasegawa et al. |
| 5,630,195 | A | 5/1997 | Sawayama et al. |
| 5,761,570 | A | 6/1998 | Sawayama et al. |
| 5,857,131 | A | 1/1999 | Hasegawa |
| 5,860,038 | A | 1/1999 | Kato et al. |
| 6,055,386 | A | 4/2000 | Kato et al. |
| 6,160,569 | A | 12/2000 | Fujimori et al. |
| 6,496,677 | B2 | 12/2002 | Fujimori |
| 6,975,338 | B2 | 12/2005 | Hirai et al. |
| 7,151,901 | B2 | 12/2006 | Hirai |
| 7,193,642 | B2 | 3/2007 | Hirai et al. |
| 7,228,081 | B2 | 6/2007 | Hasegawa et al. |

(Continued)

FOREIGN PATENT DOCUMENTS

JP 2003-280355 10/2003

(Continued)

*Primary Examiner* — Hoang Ngo
(74) *Attorney, Agent, or Firm* — Oblon, Spivak, McClelland, Maier & Neustadt, L.L.P.

(57) ABSTRACT

In a reuse method for reusing a reusable device and a sensor of a first image forming apparatus having a first process linear velocity in a second image forming apparatus having at least one second process linear velocity different from the first process linear velocity, the reusable device and the sensor are installed in the first image forming apparatus, and when the first image forming apparatus switches from the first process linear velocity to the second process linear velocity at an initial state before the reusable device is used, output of the sensor at the second process linear velocity is measured. When information on the output of the sensor at the second process linear velocity is stored, the reusable device and the sensor are removed from the first image forming apparatus and installed in the second image forming apparatus.

13 Claims, 10 Drawing Sheets

U.S. PATENT DOCUMENTS

| | | | | |
|---|---|---|---|---|
| 7,251,420 | B2 | 7/2007 | Fujimori et al. | |
| 7,603,046 | B2 * | 10/2009 | Hirayama | 399/27 |
| 2004/0251435 | A1 | 12/2004 | Sawayama et al. | |
| 2008/0170220 | A1 | 7/2008 | Sawayama et al. | |

FOREIGN PATENT DOCUMENTS

| | | |
|---|---|---|
| JP | 2005-172868 | 6/2005 |
| JP | 2006-171158 | 6/2006 |

* cited by examiner

REUSE METHOD AND A REUSABLE DEVICE FOR AN IMAGE FORMING APPARATUS HAVING A FIRST PROCESS LINEAR VELOCITY AND A SECOND IMAGE PROCESSING APPARATUS HAVING A SECOND PROCESS LINEAR VELOCITY

CROSS-REFERENCE TO RELATED APPLICATIONS

The present application is based on and claims priority from Japanese Patent Application No. 2008-122295, filed on May 8, 2008 in the Japan Patent Office, the entire contents of which are hereby incorporated herein by reference.

BACKGROUND OF THE INVENTION

1. Field of the Invention

Exemplary aspects of the present invention relate to a reuse method and an image forming apparatus, and more particularly, to a reuse method and an image forming apparatus for efficiently reusing a reusable device and a sensor in another image forming apparatus.

2. Description of the Related Art

Related-art image forming apparatuses, such as copiers, facsimile machines, printers, and multifunction devices having at least one of copying, printing, scanning, and facsimile functions, typically form an image on a recording material (e.g., a sheet) based on image data using electrophotography.

For example, when an electrostatic latent image is formed on a surface of a photoconductor, serving as an image carrier, a development device develops the electrostatic latent image with a developer (e.g., a two-component developer) into a visible toner image. The two-component developer includes toner and carrier. The development device stirs the toner and the carrier to charge them by friction. Then, when the charged toner adheres to an electrostatic latent image formed on an image carrier, a toner image is formed as a visible image.

In order to form a toner image on the image carrier, as the development device supplies toner to the image carrier, the amount of toner remaining in the development device decreases, so that a ratio between the amount of toner and the amount of carrier in the developer changes from an original state. However, for good imaging quality, it is important to maintain a constant ratio between the amount of toner and the amount of carrier, which ratio is also hereinafter referred to as toner density. Therefore, one related-art image forming apparatus includes a toner density sensor to monitor the toner density. When the toner density sensor detects that the toner density falls below a threshold density, fresh toner is supplied to the development device so as to maintain a predetermined toner density.

The toner density sensor can be a magnetic sensor, which detects changes in toner density by detecting changes in magnetic permeability of the developer. However, since magnetic sensors in general tend to be highly sensitive, and tend to be affected by errors in the manufacture of components of the sensor and the like. Consequently, each magnetic sensor outputs a slightly different reading from any other, that is, handles the relation between toner density and output voltage differently.

In order to prevent such variations in accuracy of the magnetic sensor, the image forming apparatus performs an initial adjustment of a control voltage of the magnetic sensor before use of the development device. The new development device initially stores developer having a predetermined toner density of 5%, for example. While the development device stirs the developer, the magnetic sensor detects toner density. The image forming apparatus adjusts the control voltage of the magnetic sensor such that the output voltage of the magnetic sensor becomes a voltage of 3 V, for example, when the predetermined toner density is 5%. Having thus calibrated the relation between the toner density and the output voltage, thereafter, fresh toner is added to the development device to increase the toner density to, for example, 7%, or a level that is appropriate for good image formation.

The new development device initially has a toner density of 5%, that is, lower than the 7% appropriate for image formation, because typically toner stored in the development device at the beginning of use is not electrically charged and thus easily scatters when the developer is stirred. As the amount of toner stored in the development device increases, the toner density also increases. Therefore, the initial toner density in the new development device is purposely set low in advance, thereby reducing scattering of toner in initial stirring of the developer. Then, the toner is charged by stirring, and toner density is increased by adding more toner.

This matter of toner density and its control becomes important when it comes to attempting to recycle components of the image forming apparatus. Such recycling first requires a brief discussion of the structure of a typical image forming apparatus, which now follows.

Typically, related-art image forming apparatuses using electrophotography include a photoconductor carrying a toner image, a charger charging a surface of the photoconductor, an exposure device exposing the charged surface of the photoconductor to form an electrostatic latent image, and a development device supplying toner to the electrostatic latent image formed on the surface of the photoconductor to form a toner image thereon.

Each of the above devices has a different service life from any other. Thus, for example, the photoconductor has a shorter service life than that of the development device. Therefore, when the photoconductor reaches the end of its life, the development device and the toner density sensor can still be used in another image forming apparatus.

However, as any given image forming apparatus has a process linear velocity different from that of any other image forming apparatus, the calibration of the toner density sensor for one development device, that is, the adjustment of the relation between the toner density sensor and the output voltage determined at the process linear velocity of the image forming apparatus which has used the development device and the toner density sensor, cannot usually be directly applied to another image forming apparatus without some adjustment. In other words, the toner density sensor needs to be calibrated again to set the correct, predetermined relation between the toner density and the output voltage for any given development device of any given image forming apparatus.

However, in order to adjust the control voltage of the toner density sensor, the toner density in the development device needs to be precisely known. Since the development device has already been used, the toner density in the development device differs from the initial toner density (5%), and it is difficult to know an exact toner density in the development device. Therefore, when the development device and the toner density sensor are reused, the toner density sensor cannot precisely detect the toner density.

Accordingly, there is a need for a technology capable of providing a method of reusing a development device and a toner density sensor as described above.

BRIEF SUMMARY OF THE INVENTION

This specification describes a reuse method according to illustrative embodiments of the present invention. In one illustrative embodiment of the present invention, the reuse method reuses a reusable device and a sensor of a first image forming apparatus having a first process linear velocity in a second image forming apparatus having at least one second process linear velocity different from the first process linear velocity. The reuse method includes installing the reusable device and the sensor in the first image forming apparatus, measuring output of the sensor at the second process linear velocity of the second image forming apparatus when the first image forming apparatus switches from the first process linear velocity to the second process linear velocity of the second image forming apparatus in an initial state before starting to use the reusable device, storing information on the output of the sensor at the second process linear velocity of the second image forming apparatus, removing the reusable device and the sensor from the first image forming apparatus and installing the reusable device and the sensor in the second image forming apparatus, reading the stored information, and adjusting the output of the sensor to correspond to the second process linear velocity of the second image forming apparatus based on the read information.

This specification further describes an image forming apparatus according to illustrative embodiments of the present invention. In a further illustrative embodiment of the present invention, the image forming apparatus switches from a first process liner velocity to at least one second process linear velocity, and includes a reusable device, a sensor, a measurement device, and a storage device. The sensor detects a state of the reusable device at a first process linear velocity. The measurement device measures output of the sensor at least one second process linear velocity in an initial state before starting to use the reusable device. The storage device stores information on the output of the sensor at the second process linear velocity in the initial state.

This specification further describes an image forming apparatus according to illustrative embodiments of the present invention. In a further illustrative embodiment of the present invention, the image forming apparatus operates at least one process linear velocity, and includes a reusable device, a sensor, a storage device, a reader, and an adjuster. The reusable device is installed in the image forming apparatus for reuse. The sensor detects a state of the reusable device. The storage device stores information on output of the sensor at the process linear velocity in an initial state before starting to use the reusable device. The reader reads the information stored by the storage device. The adjuster adjusts the output of the sensor to correspond to the process linear velocity based on the information read by the reader.

BRIEF DESCRIPTION OF THE DRAWINGS

A more complete appreciation of the invention and the many attendant advantages thereof will be more readily obtained as the same becomes better understood by reference to the following detailed description when considered in connection with the accompanying drawings, wherein:

FIG. 11A is a flowchart of a reuse method using the first image forming apparatus shown in FIG. 6 and the second image forming apparatus shown in FIG. 8;

DETAILED DESCRIPTION OF THE INVENTION

Figure 1:
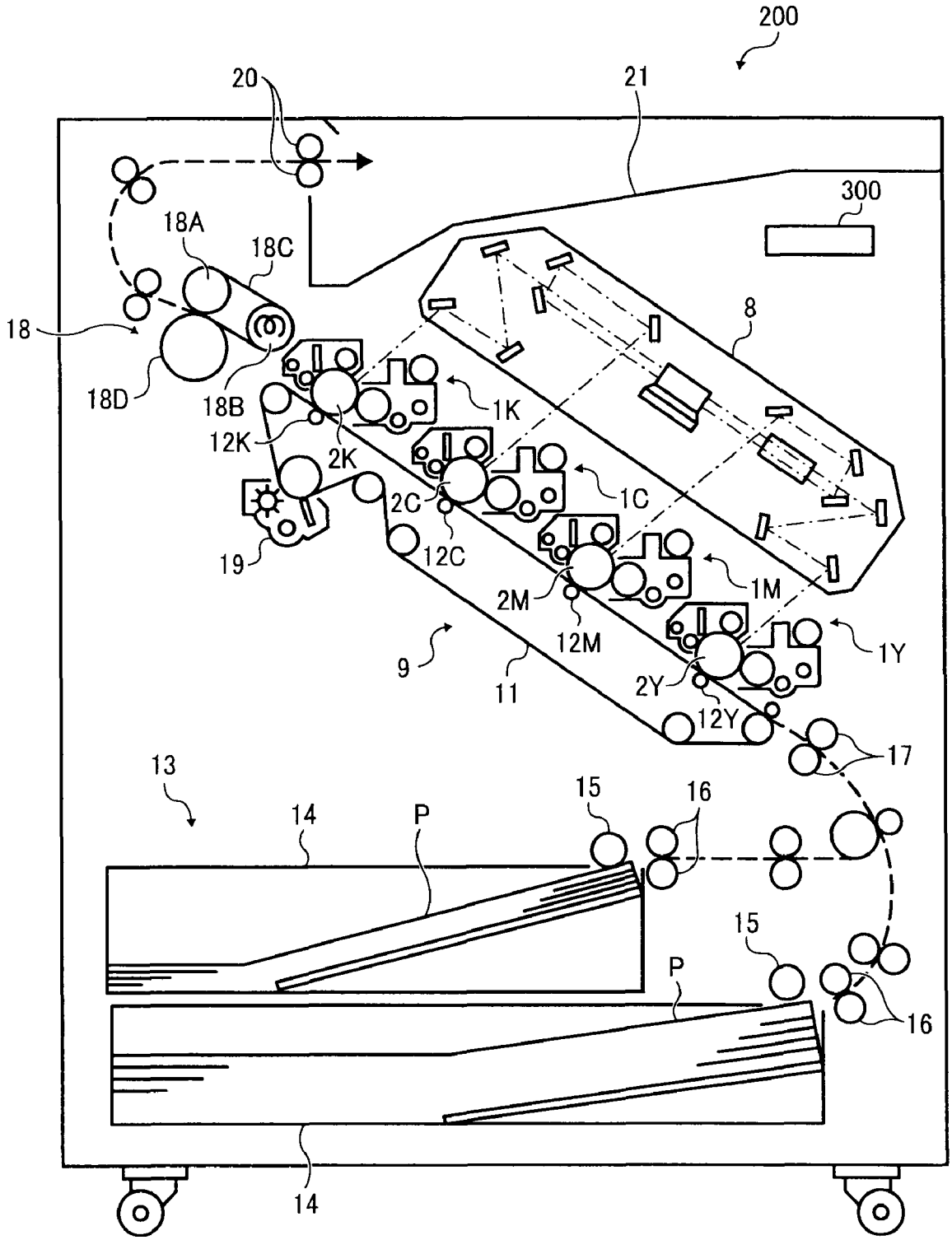
FIG. 1 is a schematic view of an image forming apparatus according to an illustrative embodiment of the present invention.

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 200 according to an illustrative embodiment of the present invention is described.

FIG. 1 is a schematic view of the image forming apparatus 200. The image forming apparatus 200 includes image forming devices 1Y, 1M, 1C, and 1K, an exposure device 8, a transfer conveyance belt device 9, a feeding device 13, a fixing device 18, discharge rollers 20, a discharge device 21, and a controller 300. The image forming devices 1Y, 1M, 1C, and 1K include photoconductors 2Y, 2M, 2C, and 2K, respectively. The transfer conveyance belt device 9 includes a conveyance belt 11, transfer bias rollers 12Y, 12M, 12C, and 12K, a belt cleaner 19, and a pair of registration rollers 17. The feeding device 13 includes a paper tray 14, a separation roller 15, and a pair of feed rollers 16. The fixing device 18 includes a fixing roller 18A, a heating roller 18B, a fixing belt 18C, and a pressing roller 18D.

The image forming apparatus 200 may be a copier, a facsimile machine, a printer, a plotter, a multifunction printer having at least one of copying, printing, scanning, plotter, and facsimile functions, or the like. According to this illustrative embodiment, the image forming apparatus 200 forms a full color toner image by superimposing yellow, magenta, cyan, and black toner images on each other on the conveyance belt 11. However, it is to be noted that the image forming apparatus 200 is not limited to the full color image forming apparatus and may form a color and/or monochrome image with other structure.

The image forming devices 1Y, 1M, 1C, and 1K form yellow, magenta, cyan, and black toner images, respectively, with developer (e.g., toner) corresponding to color separation components of a color image.

The image forming devices 1Y, 1M, 1C, and 1K have the same structure, except that they store different color toner.

The exposure device 8 is provided above the image forming devices 1Y, 1M, 1C, and 1K, and forms an electrostatic latent image on each surface of the photoconductors 2Y, 2M, 2C, and 2K. The transfer conveyance belt device 9 is provided below the image forming devices 1Y, 1M, 1C, and 1K.

The endless conveyance belt 11 is wrapped around a plurality of rollers including a driving roller, a driven roller, and the like. The transfer bias rollers 12Y, 12M, 12C, and 12K oppose the photoconductors 2Y, 2M, 2C, and 2K via the conveyance belt 11 to form respective transfer nips therebetween.

The feeding device 13 is provided in a lower portion of the image forming apparatus 200. The paper tray 14 stores recording materials P (e.g., print sheets, OHP (overhead projector) films, or the like). The separation roller 15 separates one sheet of recording material P from other recording materials P stored in the paper tray 14. The feed roller 16 feeds the recording material P separated by the separation roller 15.

The pair of registration rollers 17 is provided below and to the right of the transfer conveyance belt device 9, and temporarily stops the conveyed recording material P. The fixing device 18 is provided above and to the left of the transfer conveyance belt device 9. The fixing belt 18C is wrapped around the fixing roller 18A and the heating roller 18B. The pressing roller 18D opposes and presses the fixing roller 18A to form a fixing nip therebetween.

The discharge roller 20 and the discharge device 21 are provided in an upper portion of the image forming apparatus 200. The discharge roller 20 discharges a recording material P to the outside of the image forming apparatus 200. The discharge device 21 stores the recording material P discharged by the discharge roller 20.

Figure 2:
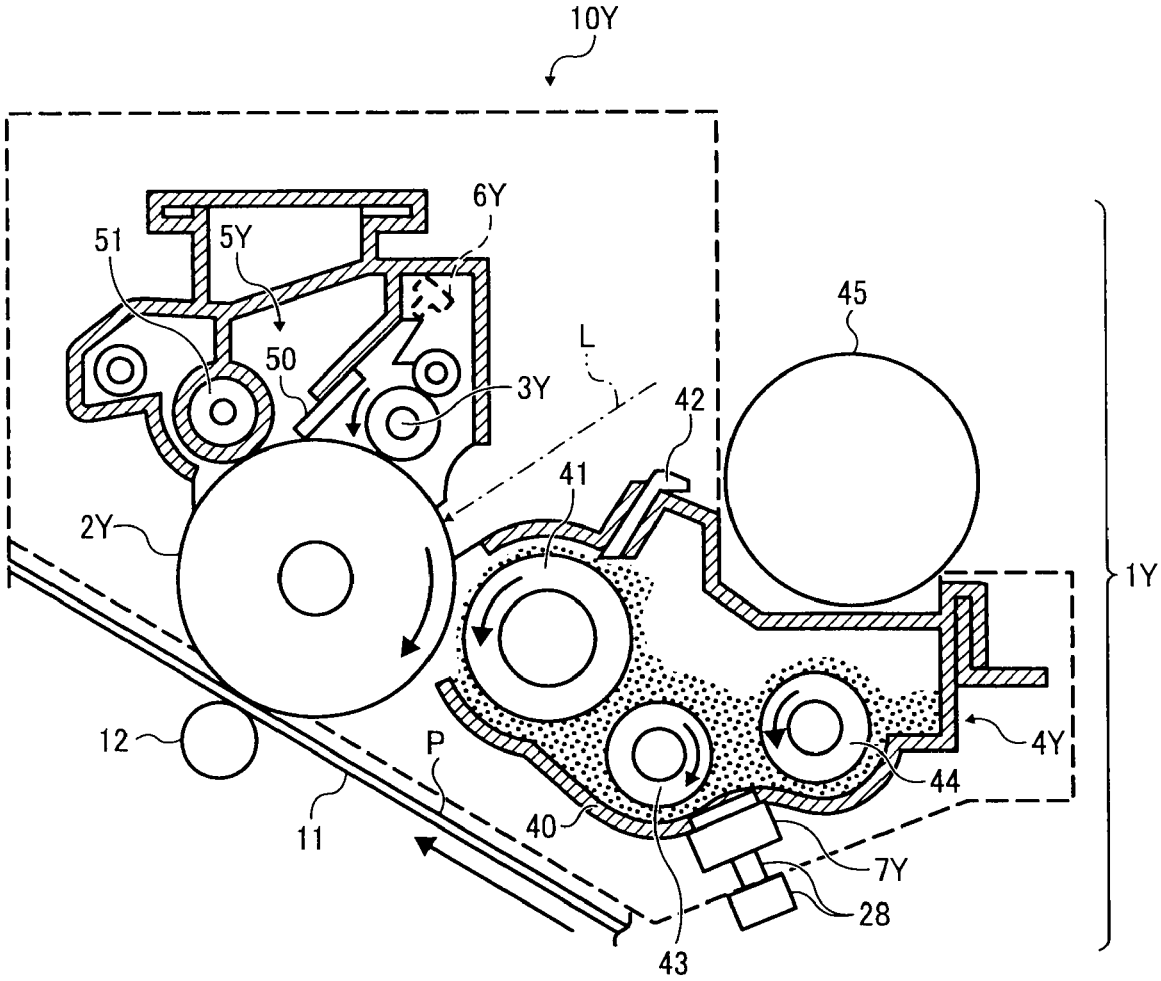
FIG. 2 is a schematic sectional view of the image forming device 1Y included in the image forming apparatus shown in FIG. 1.

Referring to FIG. 2, a description is now given of a structure of the image forming device 1Y. It is to be noted that the image forming devices 1M, 1C, and 1K have a structure equivalent to that of the image forming device 1Y.

FIG. 2 is a schematic sectional view of the image forming device 1Y. The image forming device 1Y includes a process unit 10Y. The process unit 10Y includes the photoconductor 2Y, a charging roller 3Y, a development device 4Y, a cleaner 5Y, and a discharge lamp 6Y. The development device 4Y includes a development case 40, a development roller 41, a doctor blade 42, a first conveyance screw 43, a second conveyance screw 44, a pump 45, a toner density sensor 7Y, and a connector 28. The cleaner 5Y includes a cleaning blade 50 and a cleaning brush roller 51.

The process unit 10Y is detachably attached to a body of the image forming apparatus 200. The photoconductor 2Y, serving as an image carrier, carries a toner image. The charging roller 3Y charges the photoconductor 2Y. The development device 4Y supplies yellow toner to the photoconductor 2Y. The cleaner 5Y cleans a surface of the photoconductor 2Y. The discharge lamp 6Y discharges the photoconductor 2Y.

The development case 40 stores developer including toner and carrier. The development roller 41 carries the developer. The doctor blade 42 controls thickness of the developer carried by the development roller 41 so as to maintain a uniform thickness of the developer. The toner density sensor 7Y is provided in the development case 40, and detects density of the yellow toner. For example, the toner density sensor 7Y is a magnetic sensor for detecting a change in magnetic permeability of the developer.

Operation of the image forming apparatus 200 is described with reference to FIGS. 1 and 2.

When the charging roller 3Y depicted in FIG. 2 uniformly charges the surface of the photoconductor 2Y to a high electrical potential, the exposure device 8Y depicted in FIG. 1 emits a laser beam L that is directed onto the surface of the photoconductor 2Y based on image data, so that electrical potential of the radiated portion of the surface of the photoconductor 2Y decreases, thereby forming an electrostatic latent image thereon.

As illustrated in FIG. 2, when the first conveyance screw 43 and the second conveyance screw 44 of the development device 4Y stir and convey the developer, the developer is charged by friction, so that the charged developer is carried on a surface of the rotating development roller 41. Then, the doctor blade 42 equalizes the thickness of the developer carried by the development roller 41. Thereafter, yellow toner carried by the development roller 41 adheres to the electrostatic latent image formed on the photoconductor 2Y at a development area in which the development roller 41 opposes the photoconductor 2Y, thereby forming a visible yellow toner image on the surface of the photoconductor 2Y. As with the image forming device 1Y, the image forming devices 1M, 1C, and 1K form magenta, cyan, and black toner images on the photoconductors 2M, 2C, and 2K, respectively. After the yellow toner image is transferred onto a transfer material P, the cleaner 5Y cleans the surface of the photoconductor 2Y, and the discharge lamp 6Y discharges the surface of the photoconductor 2Y.

The separation roller 15 of the feeding device 13 depicted in FIG. 1 rotates to separate one sheet of recording material P from other recording materials P stored in the paper tray 14. When the feed roller 16 feeds the separated recording material P to the pair of registration rollers 17, the pair of registration rollers 17 stops the recording material P.

After the yellow toner image is carried on the surface of the photoconductor 2Y, the pair of registration rollers 17 resumes rotating to feed the recording material P to the conveyance belt 11. As the conveyance belt 11 rotates, the recording material P is conveyed to the transfer nip formed between the transfer bias roller 12Y and the photoconductor 2Y carrying the yellow toner image. The transfer bias roller 12Y is supplied with a transfer bias at the transfer nip, thereby electrostatically transferring the yellow toner image formed on the photoconductor 2Y to the recording material P.

Similarly, the magenta, cyan, and black toner images formed by the image forming devices 1M, 1C, and 1K are transferred and superimposed on the recording material P.

When the recording material P bearing the respective color toner images is conveyed to the fixing device 18 depicted in FIG. 1, the recording material P is sandwiched between the fixing roller 18A and the pressing roller 18D and supplied with heat and pressure, thereby fixing a full color toner image on the recording material P. Then, the discharge rollers 20 discharge the recording material P to the discharge device 21. After toner image formation, when the toner density sensor 7Y, serving as a component state sensor, detects that the toner density decreases to less than a predetermined density, fresh yellow toner is supplied to the development device 4Y.

Figure 3:
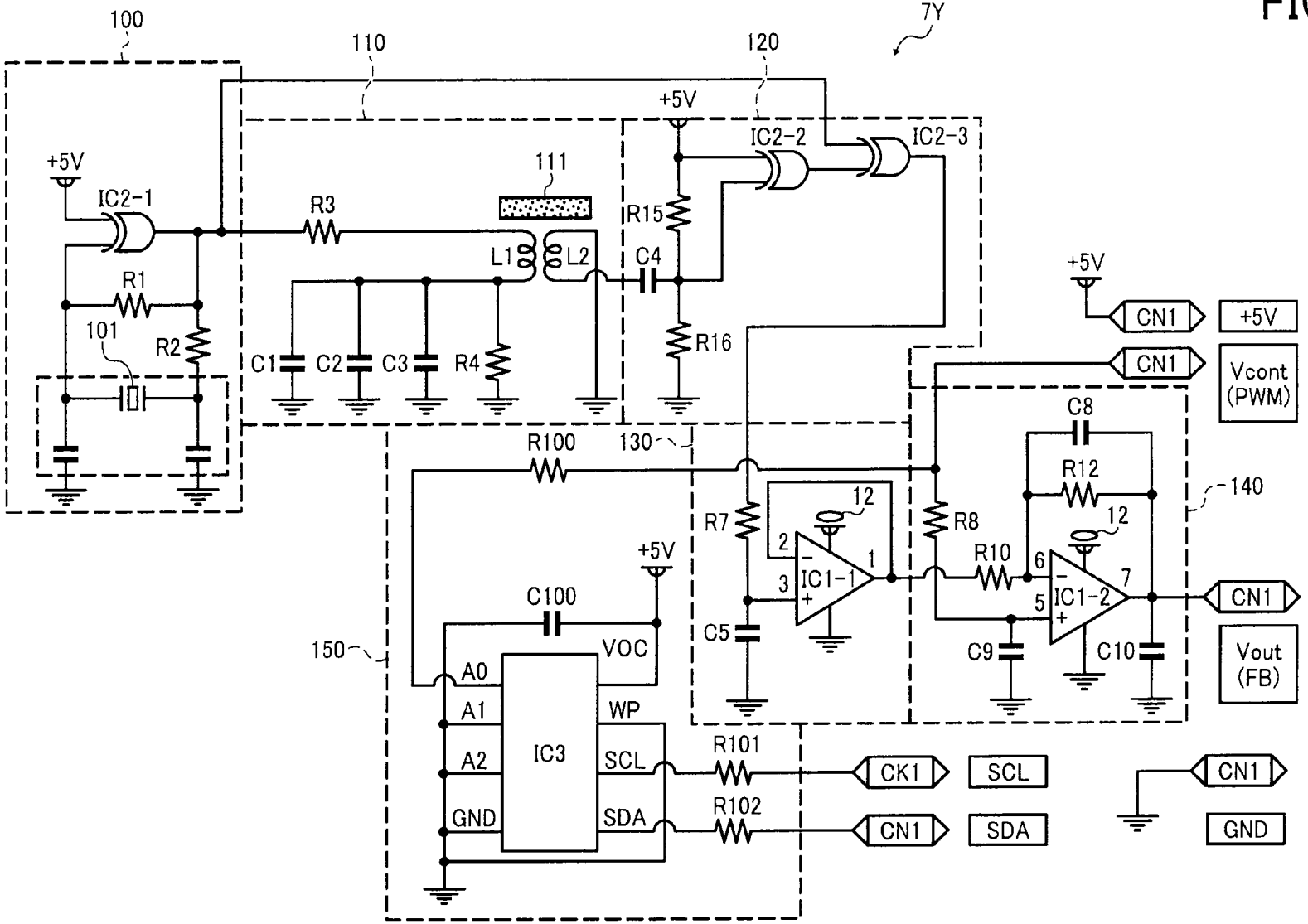
FIG. 3 is a circuit diagram of a toner density sensor included in the image forming device 1Y shown in FIG. 2.

Referring to FIG. 3, a description is now given of a circuit configuration of the toner density sensor 7Y.

FIG. 3 is a circuit diagram of the toner density sensor 7Y. As illustrated in FIG. 3, the toner density sensor 7Y includes an oscillator 100, a resonator circuit 110, a phase comparator 120, a smoothing circuit 130, an amplifier 140, and a memory chip (an IC (integrated circuit) chip) 150. The oscillator 100 includes an oscillator element 101. The resonator circuit 110 includes a resistor R3, a first coil L1, a second coil L2, and condensers C1, C2, and C3. The phase comparator 120 includes an inverting amplifier IC2-2 and a comparator IC2-3. The smoothing circuit 130 includes an Op-Amp (operational amplifier) IC1-1. The amplifier 140 includes an Op-Amp IC1-2.

The memory chip 150 is provided on the same substrate as that of the toner density sensor 7Y. The memory chip 150 is a nonvolatile memory capable of storing information when not powered. The memory chip 150 stores a production lot and usage of a component (the photoconductor 2Y, the development device 4Y, the toner density sensor 7Y, or the like) installed in the process unit 10Y depicted in FIG. 2. The memory chip 150 updates such information by communicating with the image forming apparatus 200 via the connector 28 depicted in FIG. 2. Alternatively, the memory chip 150 may include an antenna for wirelessly transmitting and receiving information.

Figure 4:
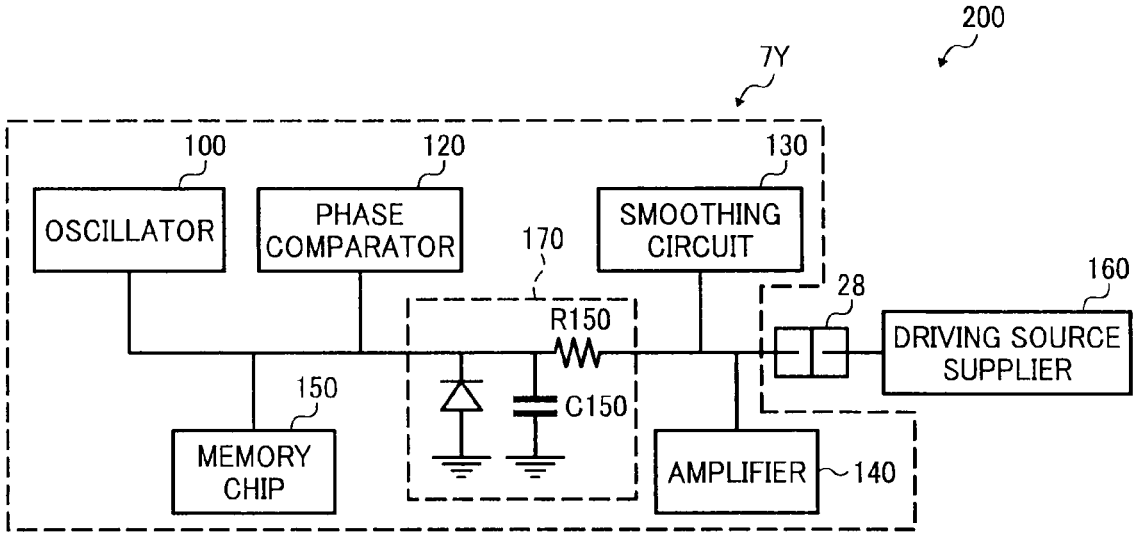
FIG. 4 is a schematic diagram of a source circuit included in the image forming apparatus shown in FIG. 1.

Referring to FIGS. 4 and 5A, 5B, 5C, 5D, and 5E, a description is now given of a circuit for supplying a driving source to each circuit of the toner density sensor 7Y. FIG. 4 is a schematic diagram of the source circuit. The toner density sensor 7Y further includes a step-down circuit 170. The image forming apparatus 200 further includes a driving source supplier 160. FIGS. 5A, 5B, 5C, 5D, and 5E illustrate respective waveforms of a voltage output from the respective circuits.

Before the driving source supplier 160 supplies a voltage of about 12 V to each circuit via the connector 28, the step-down circuit 170 decreases the voltage of about 12 V down to about 5 V to be supplied to the oscillator 100, the phase comparator 120, and the memory chip 150, respectively, whereas a voltage of about 12 V is supplied to the Op-Amp IC1-1 of the smoothing circuit 130 and the Op-Amp IC1-2 of the amplifier 140, respectively.

Figure 5A:
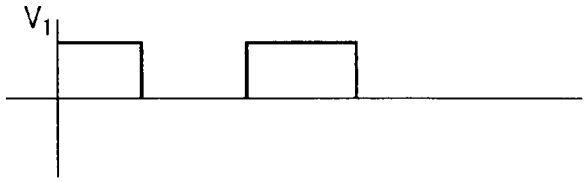
FIG. 5A is a graph of a waveform output from an oscillator included in the toner density sensor shown in FIG. 2.

The oscillator 100 oscillates at a frequency of about 4 MHz using the oscillator element 101 depicted in FIG. 3 made of crystal, ceramics, or the like, and is supplied with the voltage of about 5 V decreased by the step-down circuit 170. The oscillator 100 converts the voltage of about 5 V into a voltage $V_1$ having a rectangular waveform of about 4 MHz, as illustrated in FIG. 5A, to be output to the resonator circuit 110 depicted in FIG. 3. FIG. 5A illustrates a waveform of the output voltage $V_1$ from the oscillator 100 to the resonator circuit 110.

As illustrated in FIG. 3, the resistor R3 and the first coil L1 form a first resonator circuit. The second coil L2, which forms a second resonator circuit, is combined with the first coil L1 with a magnetic binding coefficient k. Since the condensers C1, C2, and C3 are shared between the first resonator circuit and the second resonator circuit, the first resonator circuit and the second resonator circuit have the same resonance characteristics. The second coil L2 opposes the first coil L1 to form a resonance point. The output voltage $V_1$ from the oscillator 100 is input to the first coil L1 via the resistor R3, thereby increasing input impedance at the resonance point. In addition, the resistor R3 prevents unstable oscillation of the oscillator 100 due to the influence of the resonance circuit 110. It is to be noted that self-inductances of the first coil L1 and the second coil L2 are 8.15 μH.

Figure 5B:
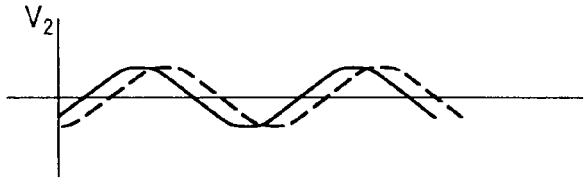
FIG. 5B is a graph of a waveform output from a resonator circuit included in the toner density sensor shown in FIG. 2.

FIG. 5B illustrates waveforms of a voltage $V_2$. The second coil L2 outputs the voltage $V_2$ canceling out the voltage $V_1$ input to the first coil L1 at the resonance point. Due to magnetic permeability of a developer 111 provided in the vicinity of the first coil L1 and the second coil L2, mutual inductance between the first coil L1 and the second coil L2 varies, so that the output voltage $V_2$ output from the second coil L2 varies.

The magnetic permeability of the developer 111 varies according to a mixture ratio between magnetic carrier and non-magnetic toner. More specifically, when toner density is low, the magnetic permeability of the developer 111 increases, and when toner density is high, the magnetic permeability of the developer 111 decreases. As illustrated in FIG. 5B, the voltage $V_2$output from the second coil L2 of the second resonance circuit has a sine wave. A solid line in FIG. 5B represents a waveform when the toner density of the developer 111 has an appropriate value, and a broken line in FIG. 5B represents a waveform when the toner density is smaller than the appropriate value. Therefore, as the toner density of the developer 111 varies, mutual impedance at the resonance point varies, thereby generating a phase difference between the waveforms of the voltage $V_2$ as indicated by the solid line and the broken line as described above.

Figure 5C:
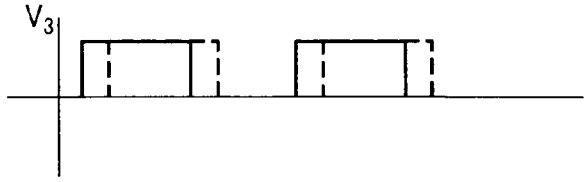
FIG. 5C is a graph of a waveform output from an inverting amplifier of a phase comparator included in the toner density sensor shown in FIG. 2.

FIG. 5C illustrates waveforms of the voltage output from the inverting amplifier IC2-2. The voltage $V_2$ output from the second coil L2 of the second resonance circuit (sine wave) is input to the phase comparator 120. The inverting amplifier IC2-2 of the phase comparator 120 inverts and amplifies the input sine wave. The comparator IC2-3 of the phase comparator 120 compares an output voltage $V_3$ output from the inverting amplifier IC2-2 and the output voltage $V_1$ output from the oscillator 100. The inverting amplifier IC2-2 inputs a direct current voltage from a source circuit, not shown, and the alternating voltage $V_2$ output from the second coil L2 to the phase comparator 120 to perform an XOR operation, and outputs a rectangular waveform as illustrated in FIG. 5C.

Figure 5D:
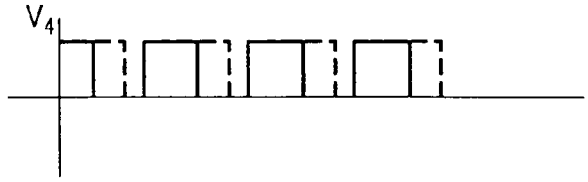
FIG. 5D is a graph of a waveform output from a comparator of the phase comparator included in the toner density sensor shown in FIG. 2.

FIG. 5D illustrates waveforms of an output voltage $V_4$ output from the phase comparator 120. The comparator IC2-3 inputs the output voltage $V_1$ from the oscillator circuit 120 and the output voltage $V_3$ from the inverting amplifier IC2-2 to perform an XOR operation, and outputs a phase component as illustrated in FIG. 5D.

As illustrated in FIG. 5D, an interval of on-state of the output waveform of the voltage $V_4$ when the toner density is low as indicated by a broken line is longer than that of the output waveform of the voltage $V_4$ when the toner density is appropriate as indicated by a solid line.

Figure 5E:
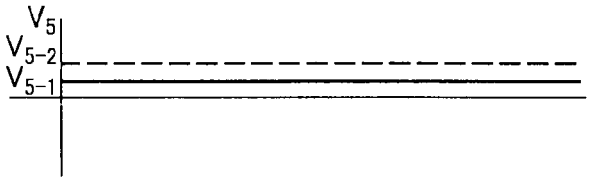
FIG. 5E is a graph of a waveform output from a smoothing circuit included in the toner density sensor shown in FIG. 2.

FIG. 5E illustrates waveforms of an output voltage $V_5$ output from the Op-Amp IC1-1. The phase comparator 120 inputs the output voltage $V_4$ to the smoothing circuit 130. The Op-Amp IC1-1 of the smoothing circuit 130 outputs flat waveforms as illustrated in FIG. 5E, which are average values of the waveforms as indicated in FIG. 5D. A solid line represents an output voltage $V_{5-1}$ when the toner density is appropriate, and a broken line represents an output voltage $V_{5-2}$ when the toner density is smaller than the appropriate value. Since the interval of on-state of the output waveform of the voltage $V_4$ when the toner density is low as indicated by a broken line depicted in FIG. 5D is longer than that of the output waveform of the voltage $V_4$ when the toner density is high, the output voltage $V_{5-2}$ when the toner density is smaller than the appropriate value is greater than the output voltage $V_{5-1}$ when the toner density has an appropriate value.

The amplifier 140 amplifies the output voltage $V_5$ output from the smoothing circuit 130. The output voltage $V_5$ has a difference of about 0.5 V even when the toner density has a maximum difference. Therefore, the amplifier 140 amplifies a voltage difference between a control voltage $V_{cont}$ and the output voltage $V_5$ output from the smoothing circuit 130 fourfold, thereby obtaining an output voltage $V_{out}$ of the toner density sensor 7Y.

Each toner density sensor 7Y has variations in a relation between toner density and output voltage (detected output), due for example to errors in the manufacture of components of the toner density sensor 7Y. Thus, before use of the development device 4Y (or the process unit 1Y), the control voltage $V_{cont}$ of the toner density sensor 7Y is calibrated such that a relation between the toner density and the output voltage has a predetermined relation. A method of calibration of the control voltage $V_{cont}$ is described below.

Developer in the development device 4Y has an initial toner density of about 5%. The memory chip 150 of the toner density sensor 7Y stores a reference output voltage of about 3 V for the predetermined toner density of about 5% and determines whether or not the output voltage $V_{out}$ of the toner density sensor 7Y is the reference output voltage of about 3 V. When the output voltage $V_{out}$ of the toner density sensor 7Y is not the reference output voltage of about 3 V, the control voltage $V_{cont}$ is adjusted such that the output voltage $V_{out}$ of the toner density sensor 7Y reaches the reference output voltage of about 3 V. Then, the memory chip 150 rewrites the value of the control voltage $V_{cont}$ stored in advance in the memory chip 150 to an adjusted value of the control voltage $V_{cont}$. Thereafter, the development device 4Y stirs the developer to increase the amount of charged toner in the development device 4. Then, based on the rewritten value of the control voltage, toner is added to the developer such that the output voltage $V_{out}$ of the toner density sensor 7Y reaches a target voltage (output voltage of about 2.2 V when the toner density is 7%).

Figure 6:
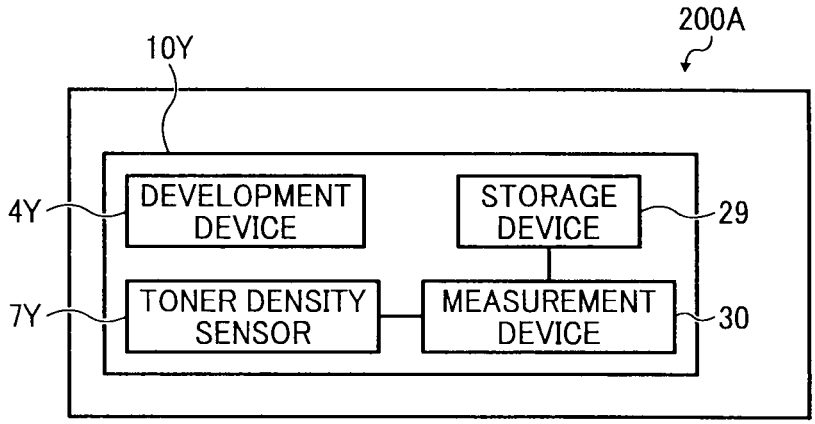
FIG. 6 is a schematic block diagram of a first image forming apparatus including the development device and the toner density sensor shown in FIG. 2.
Figure 7A:
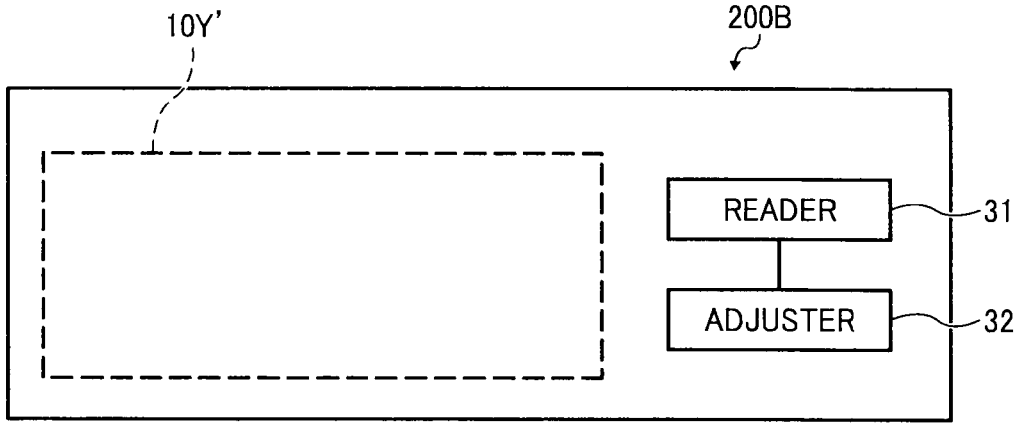
FIG. 7A is a schematic block diagram of a second image forming apparatus before installing the development device and the toner density sensor shown in FIG. 2.
Figure 7B:
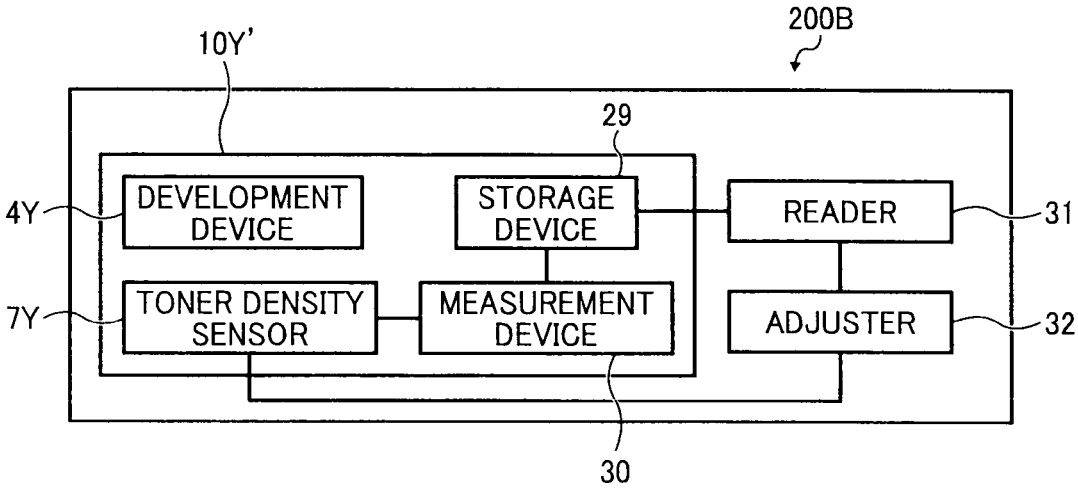
FIG. 7B is another schematic block diagram of the second image forming apparatus mounted with the development device and the toner density sensor shown in FIG. 2

Referring to FIGS. 6, 7A, and 7B, a description is now given of a reuse system for reusing the development device 4Y and the toner density sensor 7Y included in the image forming apparatus 200 for another image forming apparatus having a different process linear velocity.

FIG. 6 is a schematic block diagram of an image forming apparatus 200A. FIGS. 7A and 7B are schematic block diagrams of an image forming apparatus 200B. The image forming apparatus 200A including a development device 4Y and a toner density sensor 7Y before reuse (or reproduced) is called a first image forming apparatus. The image forming apparatus 200B reusing the development device 4Y and the toner density sensor 7Y is called a second image forming apparatus.

As illustrated in FIG. 6, the image forming apparatus 200A includes the process unit 10Y including the development device 4Y, the toner density sensor 7Y, a storage device 29, and a measurement device 30. It is to be noted that the image forming apparatus 200A has a structure equivalent to that of the image forming apparatus 200 depicted in FIG. 1, and the process unit 10Y has a structure equivalent to that of the process unit 10Y depicted in FIG. 2. Therefore, the process unit 10Y includes the photoconductor 2Y, the charging roller 3Y, and the like.

The storage device 29 is the memory chip 150 depicted in FIG. 3 of the toner density sensor 7Y. The measurement device 30 measures an output voltage $V_{out}$ of the toner density sensor 7Y. The storage device 29 stores information on the output voltage $V_{out}$ of the toner density sensor 7Y measured by the measurement device 30. The image forming apparatus 200A switches from a predetermined process linear velocity in image formation to another process linear velocity.

FIG. 7A illustrates a state of the image forming apparatus 200A before installation of the development device 4Y and the toner density sensor 7Y. FIG. 7B illustrates the image forming apparatus 200B in which the development device 4Y and the toner density sensor 7Y are installed in a process unit 10Y'. The storage device 29 and the measurement device 30 are installed in the process unit 10Y'. As illustrated in FIGS. 7A and 7B, the image forming apparatus 200B includes a reader 31 and an adjuster 32.

The reader 31 reads the information stored in the storage device 29 depicted in FIG. 6. The adjuster 32 adjusts the output voltage $V_{out}$ of the toner density sensor 7Y based on the information read by the reader 31. More specifically, the adjuster 32 adjusts the output voltage $V_{out}$ by adjusting the control voltage $V_{cont}$.

Figure 8:
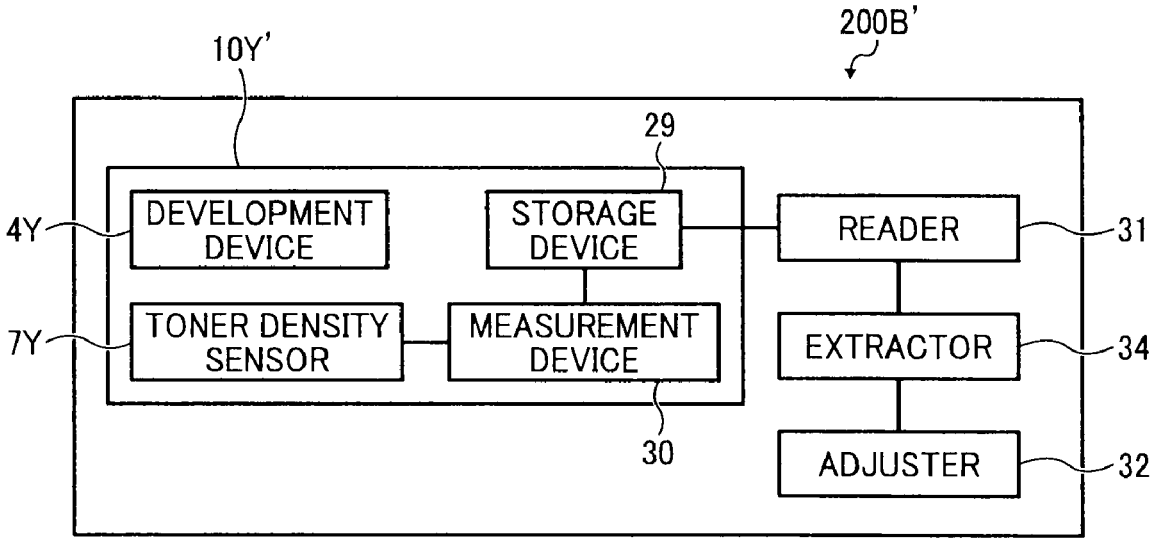
FIG. 8 is a schematic block diagram of a second image forming apparatus according to another example embodiment.

FIG. 8 illustrates an image forming apparatus 200B' according to another illustrative embodiment. The image forming apparatus 200B', serving as a second image forming apparatus, includes the reader 31, the adjuster 32, and an extractor 34.

The extractor 34 extracts specific information from the information read by the reader 31. The remainder of the configuration of the image forming apparatus 200B' is equivalent to that of the image forming apparatus 200B depicted in FIGS. 7A and 7B.

Figure 9:
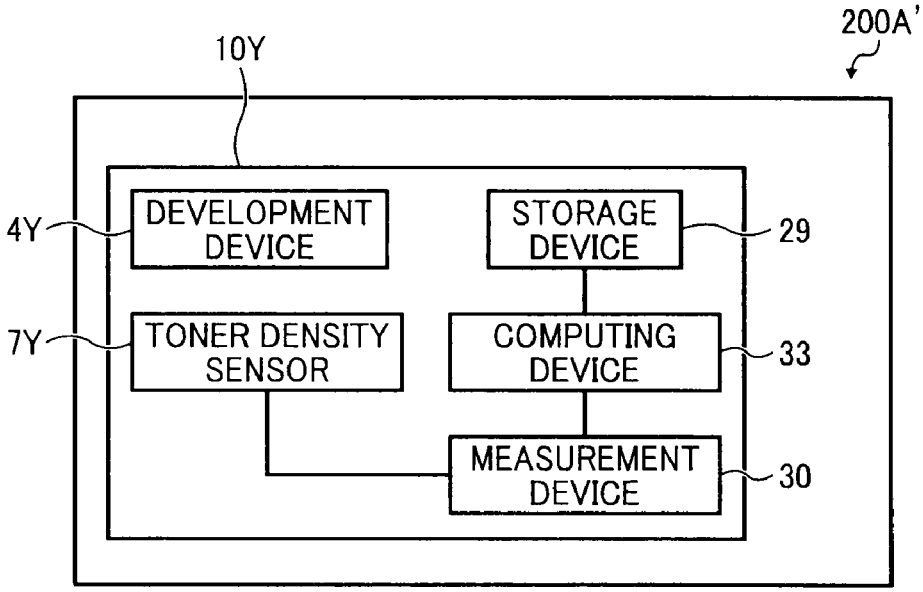
FIG. 9 is a schematic block diagram of a first image forming apparatus according to another example embodiment.

FIG. 9 illustrates an image forming apparatus 200A' according to yet another illustrative embodiment. The image forming apparatus 200A', serving as a first image forming apparatus, includes the storage device 29, the measurement device 30, and a computing device 33. The computing device 33 calculates a relational expression representing a relation between a process linear velocity and the output voltage $V_{out}$. The remainder of the configuration of the image forming apparatus 200A' is equivalent to that of the image forming apparatus 200A depicted in FIG. 6.

Figure 10A:
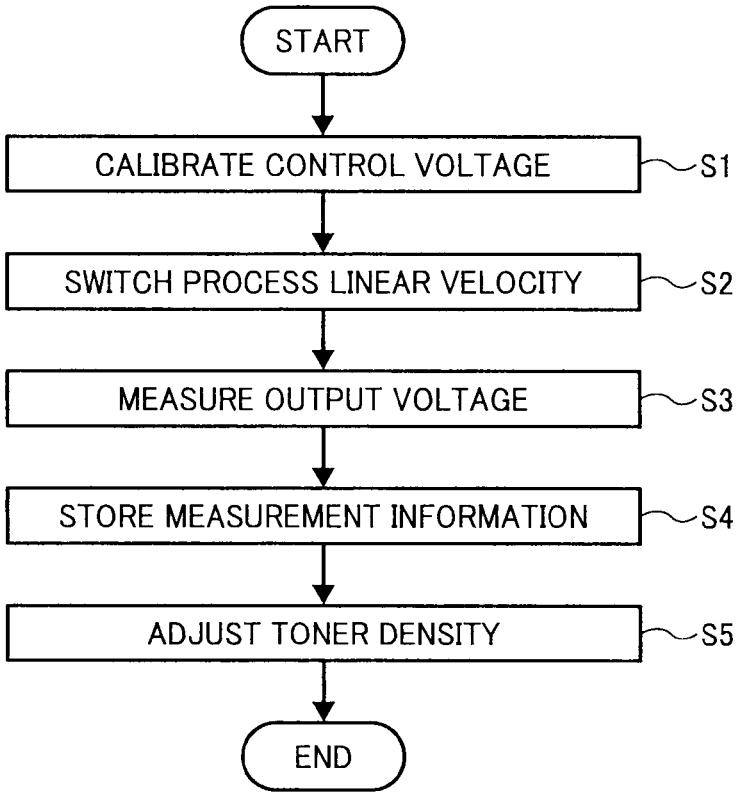
FIG. 10B is a flowchart of succeeding processes of the reuse method shown in FIG. 10A.
Figure 10B:
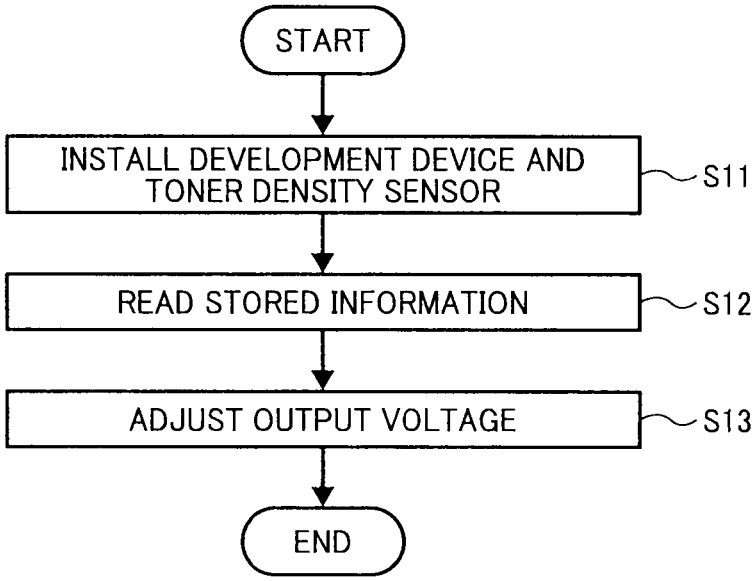

Referring to FIGS. 10A and 10B, a description is now given of a method of reusing the development device 4Y and the toner density sensor 7Y. FIG. 10A is a flowchart of the reuse method using the image forming apparatus 200A depicted in FIG. 6 and the image forming apparatus 200B depicted in FIGS. 7A and 7B. FIG. 10B is a flowchart of succeeding processes of the reuse method.

In step S1, when the development device 4Y and the toner density sensor 7Y are installed in the image forming apparatus 200A, serving as a first image forming apparatus, the controller 300 depicted in FIG. 1 orders calibration of the control voltage $C_{cont}$ of the toner density sensor 7Y. In step S2, the controller 300 orders the image forming apparatus 200A having developer in the initial state to switch from a predetermined process linear velocity to a process linear velocity of the image forming apparatus 200B. In step S3, the measurement device 30 of the image forming apparatus 200A depicted in FIG. 6 measures the output voltage $V_{out}$ of the toner density sensor 7Y at the velocity of the image forming apparatus 200B. That is, the output voltage $V_{out}$ of the toner density sensor 7Y at the velocity of the image forming apparatus 200B is measured before adjustment of the toner density in the developer to a toner density of about 7%, which is a level that is appropriate for image formation in step S5.

More specifically, in step S2, when the development device 4Y of the image forming apparatus 200A stirs developer at a velocity corresponding to the process linear velocity of the image forming apparatus 200B, the toner density sensor 7Y measures toner density of the stirred developer. Then, in step S3, the measurement device 30 measures the output voltage $V_{out}$ of the toner density sensor 7Y. During measurement of the output voltage $V_{out}$ of the toner density sensor 7Y, since toner is not supplied from the development device 4Y to the photoconductor 2Y, the toner density in the development device 4Y maintains the initial toner density of about 5%.

When the toner density sensor 7Y detects the same toner density at different process linear velocities (e.g., rates of stirring developer, or the like), output voltage $V_{out}$ of the toner density sensor 7Y varies. More specifically, when the process linear velocity is high, the output voltage $V_{out}$ of the toner density sensor 7Y when detecting the toner density decreases. Conversely, when the process linear velocity is low, the output voltage $V_{out}$ of the toner density sensor 7Y increases.

Therefore, by measuring the output voltage $V_{out}$ of the toner density sensor 7Y at the process linear velocity of the image forming apparatus 200B, the measurement device 30 obtains the relation between the process linear velocity of the image forming apparatus 200B and the output voltage $V_{out}$ of the toner density sensor 7Y. Then, as illustrated in FIG. 10A, in step S4, the storage device 29 of the image forming apparatus 200A depicted in FIG. 6 stores the information obtained by the measurement device 30. Thereafter, toner is added to the development device 4Y to adjust the toner density in the developer to about 7%, which is a level that is appropriate for image formation in step S5, and the development device 4Y is ready for use.

In step S11, the development device 4Y and the toner density sensor 7Y are installed in the image forming apparatus 200B serving as a second image forming apparatus. Also, the storage device 29 is installed in the process unit 10Y'.

In step S12, when the process unit 10Y' is installed in the image forming apparatus 200B, the reader 31 depicted in FIG. 7B included in the image forming apparatus 200B reads from the storage device 29 the relation between the process linear velocity of the image forming apparatus 200B and the output voltage $V_{out}$ of the toner density sensor 7Y. In step S13, based on that relation, the adjuster 32 depicted in FIG. 7B adjusts the output voltage $V_{out}$ of the toner density sensor 7Y to a value corresponding to the process linear velocity of the image forming apparatus 200B. More specifically, the adjuster 32 adjusts the control voltage such that the output voltage $V_{out}$ of the toner density sensor 7Y corresponds to the process linear velocity of the image forming apparatus 200B and rewrites the control voltage stored in the storage device 29 into the adjusted control voltage.

Therefore, since the output voltage $V_{out}$ of the toner density sensor 7Y is adjusted to correspond to the process linear velocity of the image forming apparatus 200B, the toner density sensor 7Y can properly detect toner density when reused for the image forming apparatus 200B.

Figure 11A:
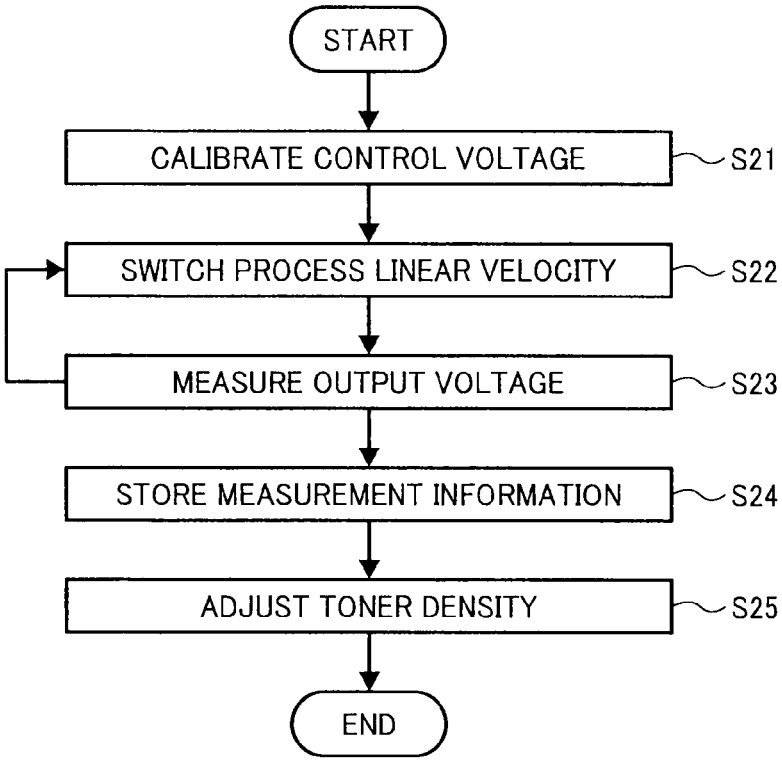
FIG. 11A is flowchart of a reuse method using the first image forming apparatus shown in FIG. 6 and the second image forming apparatus shown in FIG. 7A.
Figure 11B:
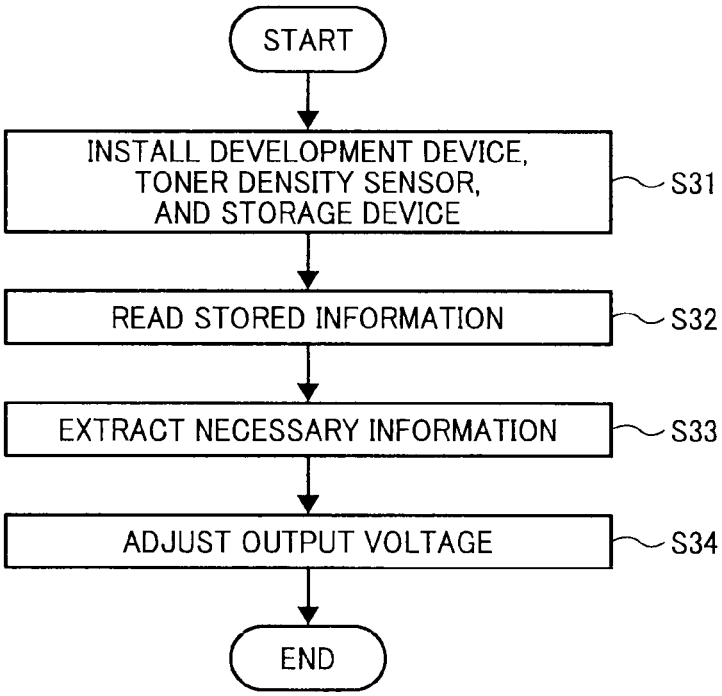
FIG. 11B is a flowchart of succeeding processes of the reuse method shown in FIG. 11A.

Referring to FIGS. 11A and 11B, a description is now given of a method of reusing the development device 4Y and the toner density sensor 7Y. FIG. 11A is a flowchart of the reuse method using the image forming apparatus 200A depicted in FIG. 6 and the image forming apparatus 200B' depicted in FIG. 8. FIG. 11B is a flowchart of succeeding processes of the reuse method.

In step S21, the controller 300 depicted in FIG. 1 orders calibration of the control voltage of the toner density sensor 7Y. In step S22, the controller 300 orders the image forming apparatus 200A having developer in the initial state to switch to a plurality of process linear velocities. The multiple process velocities are process velocities of an image forming apparatus which may reuse the development device 4Y and the toner density sensor 7Y. In step S23, when the image forming apparatus 200A switches to each process velocity, the measurement device 30 measures an output voltage $V_{out}$ of the toner density sensor 7Y at each process velocity, thereby obtaining the relation between each of the plurality of process velocities and each output voltage of the toner density sensor 7Y. In step S24, the storage device 29 stores information obtained by the measurement device 30. In step S25, toner is added to the development device 4Y, so as to adjust the toner density to a density of about the 7% appropriate for image formation.

In step S31, the development device 4Y, the toner density sensor 7Y, and the storage device 29 included in the image forming apparatus 200A are installed in the image forming apparatus 200B'. In step S32, the reader 31 depicted in FIG. 8 reads out the relation between each of the plurality of process velocities and each output voltage of the toner density sensor 7Y. Then, in step S33, the extractor 34 depicted in FIG. 8 extracts specific information from the information read by the reader 31. More specifically, the extractor 34 extracts the relation between a process linear velocity of the image forming apparatus 200B' and output voltage $V_{out}$ of the toner density sensor 7Y. In step S34, based on that relation, the adjuster 32 adjusts the output voltage of the toner density sensor 7Y to a value corresponding to the process linear velocity of the image forming apparatus 200B'. In order to reuse the development device 4Y and the toner density sensor 7Y for another image forming apparatus having a different process velocity, the extractor 34 reads out the relation between a process linear velocity of the image forming apparatus and output voltage $V_{out}$ of the toner density sensor 7Y.

According to this illustrative embodiment, the output voltage $V_{out}$ of the toner density sensor 7Y can be adjusted to correspond to one process linear velocity selected from the plurality of process liner velocities. Therefore, the development device 4Y and the toner density sensor 7Y can be reused for an image forming apparatus arbitrarily selected from a plurality of image forming apparatuses having different process linear velocities. That is, the development device 4Y and the toner density sensor 7Y can be reused for a wide variety of image forming apparatuses.

Figure 12A:
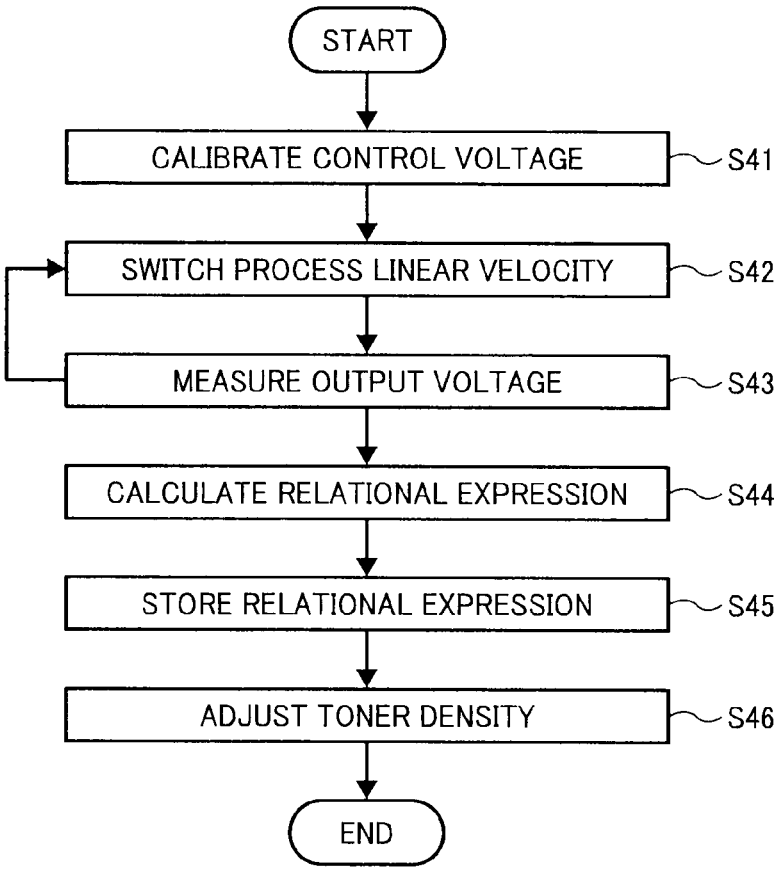
FIG. 12A is a flowchart of a reuse method using the first image forming apparatus shown in FIG. 9 and the second image forming apparatus shown in FIG. 7A.
Figure 12B:
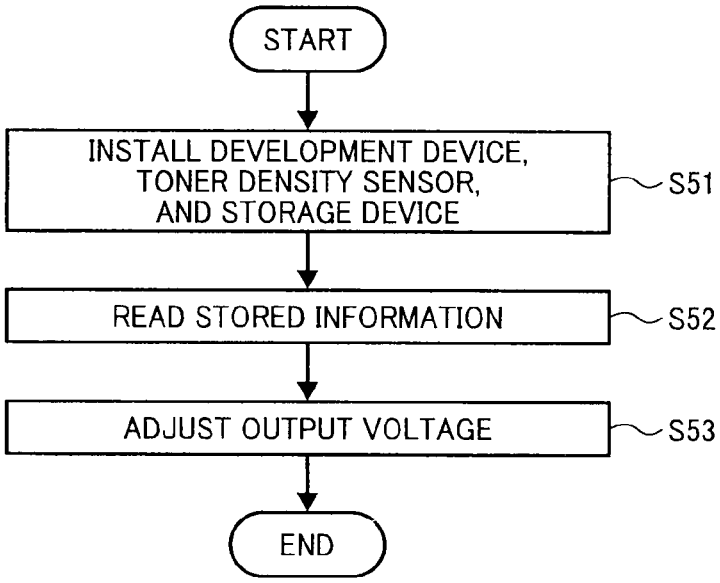
FIG. 12B is a flowchart of succeeding processes of the reuse method shown in FIG. 12A.
Figure 13:
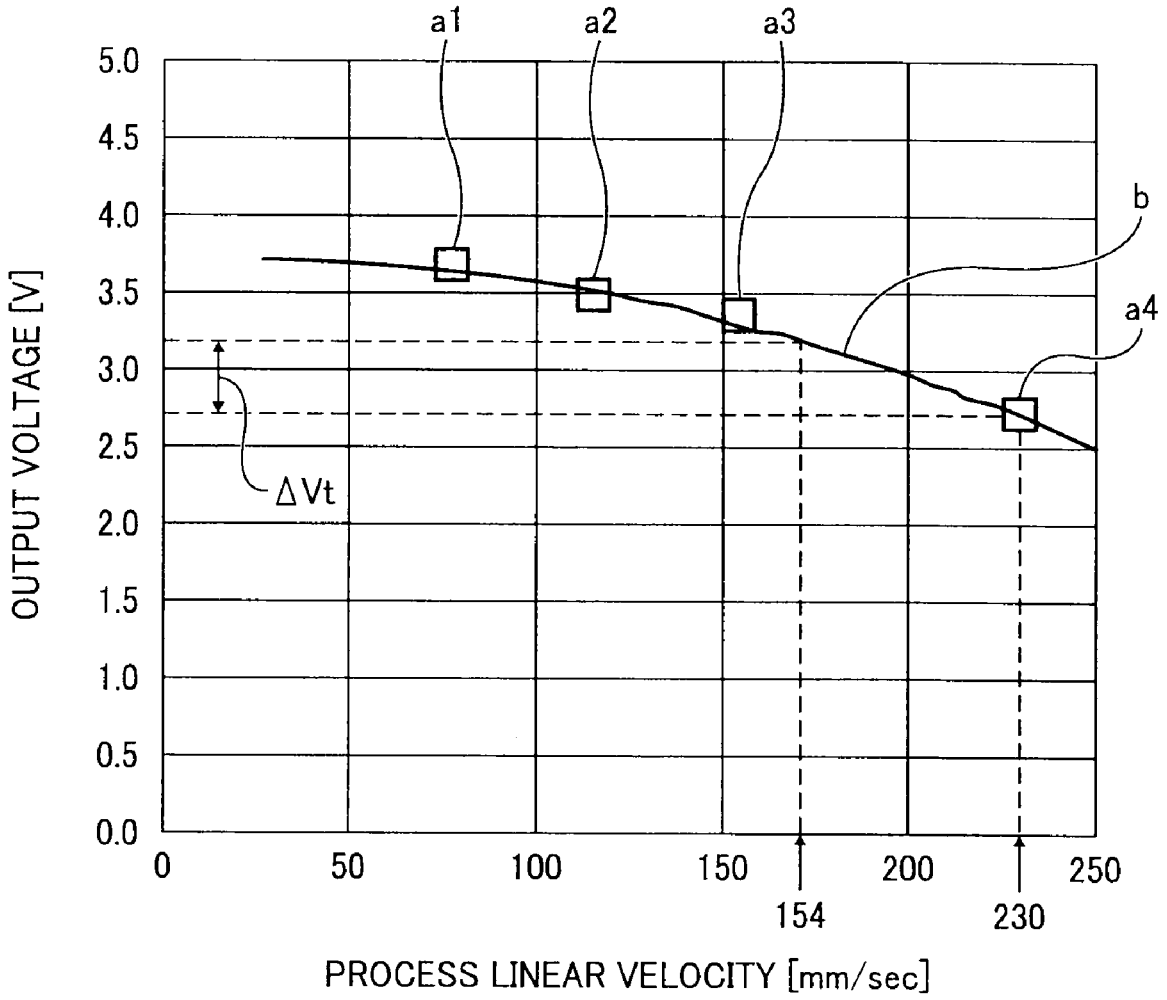
FIG. 13 is a graph illustrating a relation between a process linear velocity and an output voltage of the toner density sensor shown in FIG. 2.

Referring to FIGS. 12A and 12B, and 13, a description is now given of a method of reusing the development device 4Y and the toner density sensor 7Y. FIG. 12A is a flowchart of the reuse method using the image forming apparatus 200A' depicted in FIG. 9 and the image forming apparatus 200B depicted in FIG. 7A. FIG. 12B is a flowchart of succeeding processes of the reuse method. FIG. 13 is a graph illustrating a relation between a process linear velocity and an output voltage of the toner density sensor 7Y.

In step S41, the controller 300 depicted in FIG. 1 orders calibration of the control voltage of the toner density sensor 7Y. In step S42, the controller 300 orders the image forming apparatus 200A' having developer in the initial state to switch to a plurality of process linear velocities. The plurality of process velocities may be a process velocity of an image forming apparatus which may reuse the development device 4Y and the toner density sensor 7Y or a process linear velocity of another image forming apparatus. In step S43, when the image forming apparatus 200A' switches to each process velocity, the measurement device 30 measures output voltage $V_{out}$ of the toner density sensor 7Y at each process velocity, in step S43. Since no toner is consumed by the development device 4Y when the output voltage $V_{out}$ is measured, frequent measurement of the output voltage of the toner density sensor 7Y may cause degradation of toner provided in the development device 4Y. Therefore, the output voltage of the toner density sensor 7Y is preferably measured about 2 to 5 times, for example.

In step S44, based on a result of measurement of the output voltage, the computing device 33 depicted in FIG. 9 calculates a relational expression representing a relation between the process linear velocity and the output voltage of the toner density sensor 7Y. More specifically, as illustrated in FIG. 13, the computing device 33 plots output voltage values of the toner density sensor 7Y corresponding to each process linear velocity as indicated by dots a1, a2, a3, and a4, and calculates a relational expression representing an approximate curve line b. In step S45, the storage device 29 stores the relational expression calculated by the computing device 33.

Since the relational expression representing the relation between the process linear velocity and the output voltage is primary or polynomial based on a value of the process linear velocity, the computing device 33 may selectively switch between a mode of calculating a primary expression and a mode of calculating a polynomial expression.

As illustrated in FIG. 12B, in step S51, the development device 4Y, the toner density sensor 7Y, and the storage device 29 of the image forming apparatus 200A' are installed in the image forming apparatus 200B. In step S52, the reader 31 depicted in FIG. 7B reads a relational expression of a relation between a process linear velocity and an output voltage of the toner density sensor 7Y. Then, in step S53, based on the relational expression, the adjuster 32 adjusts the output voltage of the toner density sensor 7Y to a value corresponding to the process linear velocity of the image forming apparatus 200B. For example, when the image forming apparatus 200A' depicted in FIG. 9 generally uses a process linear velocity of 230 mm/sec, and the image forming apparatus 200B depicted in FIG. 7B uses a process linear velocity of 154 mm/sec, the difference in output voltage ΔVt of the toner density sensor 7Y at the two different process linear velocities is easily known by using the approximate curve line b depicted in FIG. 13. By subtracting the difference in output voltage ΔVt from the output voltage of the toner density sensor 7Y, the output voltage of the toner density sensor 7Y can be adjusted to correspond to the process linear velocity of the image forming apparatus 200B. Therefore, when the toner density sensor 7Y is reused in the image forming apparatus 200B, the toner density sensor 7Y can properly detect toner density.

According to this illustrative embodiment, the output voltage of the toner density sensor 7Y can be adjusted to correspond to various process linear velocities, so that various types of image forming apparatuses can reuse the development device 4Y and the toner density sensor 7Y.

According to this illustrative embodiment, since the output voltage of the toner density sensor 7Y can be adjusted to correspond to a process linear velocity of an image forming apparatus to reuse the toner density sensor 7Y, the toner density sensor 7Y can properly detect toner density.

As can be appreciated by those skilled in the art, although the present invention has been described above with reference to specific illustrative embodiments the present invention is not limited to the specific embodiments described above, and various modifications and enhancements are possible without departing from the scope of the invention. Although the image forming apparatus 200 depicted in FIG. 1 uses a direct transfer method in which a toner image is directly transferred to a recording material, the image forming apparatus 200 may use an indirect transfer method in which a toner image is transferred to the recording material via a belt member, e.g., an intermediate transfer belt. In addition, according to this illustrative embodiment, the reuse method and the reuse system can be applied not only to reusing the development device 4Y and the toner density sensor 7Y, but also to a combination of an image carrier or the like and a detector such as a photosensor provided in the image carrier. It is therefore to be understood that the present invention may be practiced otherwise than as specifically described herein. For example, elements and/or features of different illustrative embodiments may be combined with each other and/or substituted for each other within the scope of the present invention.

What is claimed is:

1. A reuse method for reusing a reusable device and a sensor of a first image forming apparatus having a first process linear velocity in a second image forming apparatus having at least one second process linear velocity different from the first process linear velocity, the method comprising:

installing the reusable device and the sensor in the first image forming apparatus;

measuring output of the sensor at the second process linear velocity of the second image forming apparatus when the first image forming apparatus switches from the first process linear velocity to the second process linear velocity of the second image forming apparatus in an initial state before starting to use the reusable device;

storing information on the output of the sensor at a second process linear velocity of the second image forming apparatus;

removing the reusable device and the sensor from the first image forming apparatus and installing the reusable device and the sensor in the second image forming apparatus;

reading the stored information; and adjusting the output of the sensor to correspond to the second process linear velocity of the second image forming apparatus based on the read information.

2. The reuse method according to claim 1, wherein, when the first process linear velocity of the first image forming apparatus switches to a plurality of process linear velocities, output of the sensor is measured at each of the plurality of process linear velocities, the reuse method further comprising:

calculating a relational expression representing a relation between the process linear velocity and the output of the sensor based on information on each output of the sensor at the plurality of process linear velocities, and storing the relational expression as the stored information.

3. The reuse method according to claim 1, wherein the reusable device is a development device supplied with toner and the sensor is a toner density sensor configured to detect toner density in the development device.

4. A first image forming apparatus for switching from a first process linear velocity of the first image forming apparatus to at least one second process linear velocity of a second image forming apparatus, comprising:

a reusable device;

a sensor configured to detect a state of the reusable device at the first and second process linear velocities;

a measurement device configured to measure output of the sensor at the second process linear velocity, used in the second image forming apparatus, in an initial state before starting to use the reusable device; and a storage device configured to store information on the output of the sensor at the second process linear velocity in the initial state.

5. The first image forming apparatus according to claim 4, wherein the first image forming apparatus is configured to switch to a plurality of process linear velocities in the initial state, the first image forming apparatus further comprising a computing device configured to calculate a relational expression representing a relation between the process linear velocity and the output of the sensor in the initial state based on the information on each output of the sensor at the plurality of process linear velocities, the first image forming apparatus configured to store the relational expression as the information stored by the storage device.

6. The first image forming apparatus according to claim 4, wherein the reusable device is a development device supplied with toner and the sensor is a toner density sensor configured to detect toner density in the development device.

7. The first image forming apparatus according to claim 4, wherein the storage device is an IC (integrated circuit) chip.

8. The first image forming apparatus according to claim 4, wherein the storage device is a nonvolatile memory.

9. An image forming apparatus for operating at at least one process linear velocity, comprising:

a reusable device installed in the image forming apparatus for reuse;

a sensor configured to detect a state of the reusable device;

a storage device configured to store information on output of the sensor at the process linear velocity and at least one additional second process linear velocity used by a second image forming apparatus in an initial state before starting to use the reusable device;

a reader configured to read the information stored by the storage device; and an adjuster configured to adjust the output of the sensor to correspond to the process linear velocity based on the information read by the reader.

10. The image forming apparatus according to claim 9, wherein the information stored by the storage device is a relational expression representing a relation between the process linear velocity and the output of the sensor.

11. The image forming apparatus according to claim 9, wherein the reusable device is a development device supplied with toner and the sensor is a toner density sensor configured to detect toner density in the development device.

12. The image forming apparatus according to claim 9, wherein the storage device is an IC (integrated circuit) chip.

13. The image forming apparatus according to claim 9, wherein the storage device is a nonvolatile memory.

* * * * *